United States Patent [19]

Greyvenstein

[11] Patent Number: 4,890,736

[45] Date of Patent: Jan. 2, 1990

[54] BAGS

[76] Inventor: Lourence C. Greyvenstein, 150 Senior Drive, Northcliff, 2195 Johannesburg, South Africa

[21] Appl. No.: 366,309

[22] Filed: Jun. 13, 1989

Related U.S. Application Data

[63] Continuation of Ser. No. 75,836, Jul. 20, 1987, abandoned.

[30] Foreign Application Priority Data

Jul. 23, 1986 [ZA] South Africa ..... 86/5477
Dec. 15, 1986 [ZA] South Africa ..... 86/9414

[51] Int. Cl.[4] ..... B65D 33/16; B65D 77/10; B65D 30/10

[52] U.S. Cl. ..... 206/390; 383/37; 383/77

[58] Field of Search ..... 383/37, 71, 77; 206/390, 389

[56] References Cited

U.S. PATENT DOCUMENTS

| | | | |
|---|---|---|---|
| 3,774,838 | 11/1973 | Christie | 229/62 |
| 3,931,886 | 1/1976 | Yamauchi | 206/390 |
| 3,961,743 | 6/1976 | Hollowell | 229/62 |
| 4,345,712 | 8/1982 | Gim | 229/62 |
| 4,445,230 | 4/1984 | Spadaro | 383/7 |

FOREIGN PATENT DOCUMENTS 1182787 2/1985 Canada .

*Primary Examiner*—William Price
*Attorney, Agent, or Firm*—Cushman, Darby & Cushman

[57] ABSTRACT

A refuse bag having four integral tie parts and a capacity substantially equal to a rectangular refuse bag having no tie parts. The bag is formed with substantially 10% less bag forming material than the rectangular refuse bag.

4 Claims, 2 Drawing Sheets

BAGS

Figure 1:
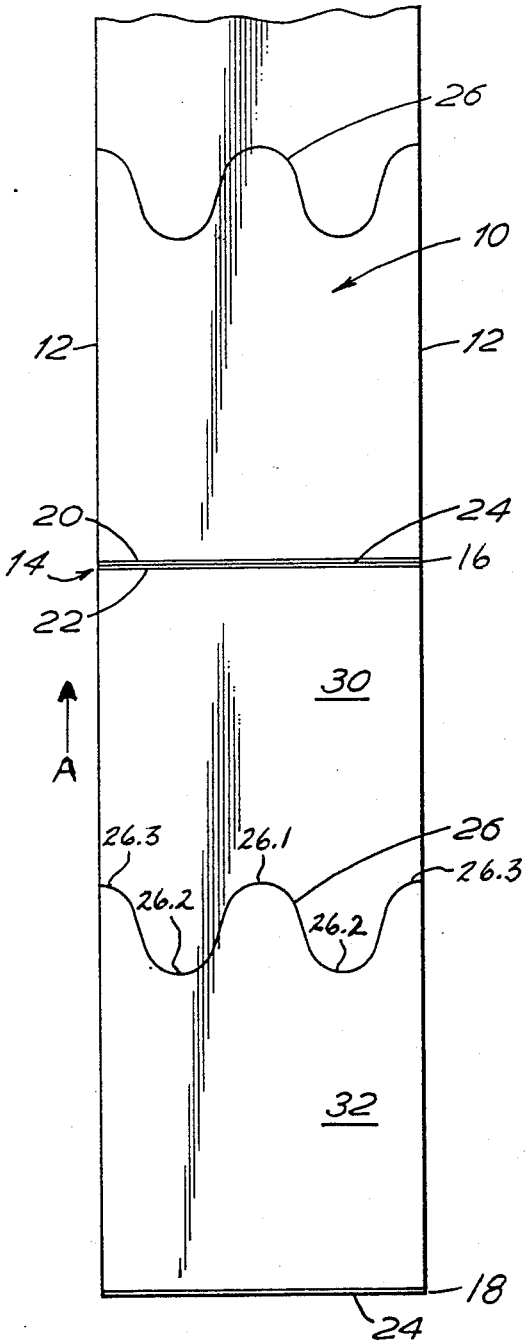

This is a continuation of Application No. 07/075,836, filed July 20, 1987, which was abandoned upon the filing hereof.

This invention relates to bags.

The invention is concerned with a bag of the kind used for storing and or transporting material such as garbage or refuse prior to collection for or transport to disposal. Such bags are formed from plastics material and comprise, in the flat condition, two rectangular panels which are not connected along only one end, so that there is an opening through which matter can be inserted into the bag. The bag is normally made from a tubular extrusion. Such a bag is hereinafter called "a bag of the kind set forth".

Bags of the kind set forth are popular and are widely used especially for preparing kitchen refuse for collection by municipal garbage collectors. A problem that is often encountered with such bags is that it is often difficult to close them especially when substantially full. As a consequence there is usually some spillage. Furthermore dogs can become aware of the contents and will destroy the bags in an attempt to reach the contents. In an attempt to close these bags these are often tied at the corners which reduces the capacity of the bags.

These bags are normally made from extruded tube from which the bags are parted. Attempts have been made to modify the shape of the bags so that they have projections or tie parts which will facilitate the closing of the open end. For example in U.S. Pat. No. 3 774 838 there is shown an arrangement wherein a large cut-out is provided near one end with a join cut to that end. This arrangement provides a pair of tie parts but it greatly reduces the capacity of the bag. In U.S. Pat. Nos. 3 961 743 and 4 445 230 there are shown arrangements wherein the parting is shaped so that a pair of projecting tie parts or tails are formed that can be so tied. With two such tie parts the closure is not as satisfactory as with four tie parts. U.S. Pat. No. 4 345 712 shows an arrangement wherein four projections or tie parts are provided. In the latter three arrangments, the base of a bag has a shape corresponding to the shape of the open end of the adjacent bag and in all the arrangements shown in these specifications the bags are gussetted which has the effect of reducing the capacity of the bag for the amount of plastic material used in forming the bag.

According to an aspect of the invention there is provided a method of manufacturing a bag of the kind set forth comprising providing front and rear panels, preferably by extruding a tube of plastics material and laying the material flat, providing straight end welds that weld the panels together at suitably spaced locations, transversely to the bag i.e. transversely to the direction of extrusion; cutting the material at an end cut adjacent to each end weld, and cutting the material at a separating cut which will form an open end for two bags between a pair of end welds and which extends generally transversely to the bag i.e. transversely to the direction of extrusion, the said separating cut being so shaped, preferably by being generally sinusoidal, that cut-outs are formed in the said open ends to leave projecting tie parts which in each bag are capable of being tied together to close the opening. With this arrangement there is a straight closed welded end and there are four tie parts. The said separating cut is preferably so arranged that the tie parts in each bag correspond to the cut-outs in the other bag of the said two bags.

Each end weld preferably comprises a pair of spaced welds and preferably the method further comprises providing an end cut between the two welds to separate the two bags from the material.

According to a further aspect of the invention there is provided a bag when manufactured as described above.

An embodiment of the invention will now be described by way of example with reference to the accompanying drawings.

Figure 2:
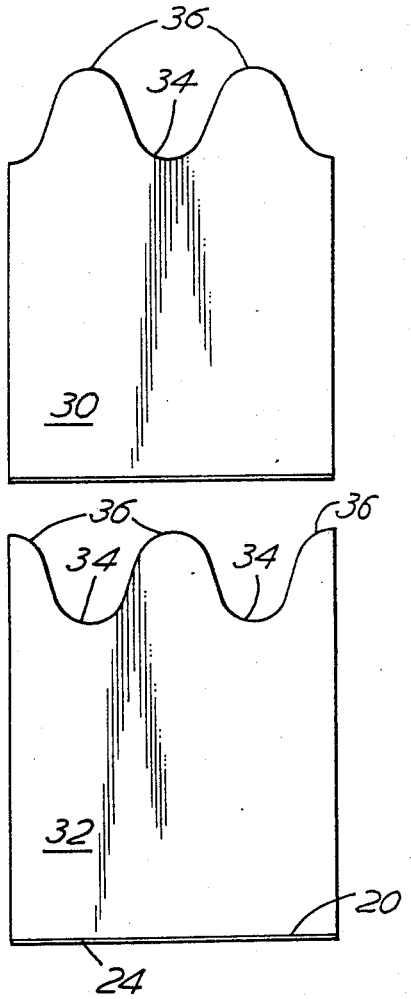
Figure 3:
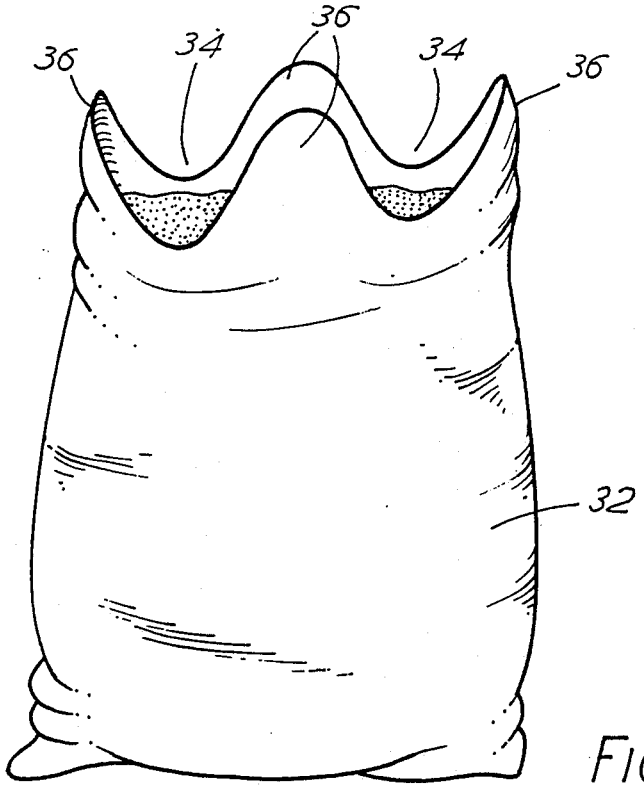
Figure 4:
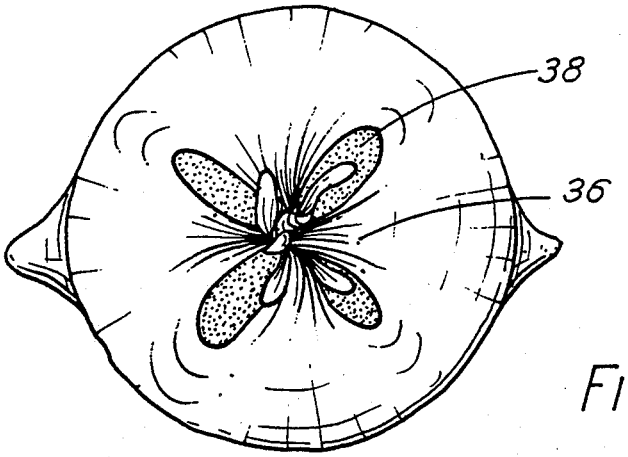

In the drawings:

FIG. 1 shows an extruded tube that has been laid flat immediately prior to separation of the bags, FIG. 2 is a side view of two bags formed from the tube, FIG. 3 is a perspective view from the side when filled but not yet closed, and FIG. 4 is a top view of the bag when filled and closed.

Referring now to FIG. 1 there is shown an extruded tube 10 of plastics material which is arranged in lay-flat form i.e. with front and rear panels joined along their edges 12 (without any gussets being formed). The tube 10 is processed in welding and cutting apparatus (not shown) which provides the welds and cuts as will be described. A straight transverse end weld 14 (that welds the front and rear panels of the material together) is provided transversely to the direction of extrusion "A" at suitably spaced locations 16 and 18. The end weld 14 comprises a pair of spaced parallel welds 20 and 22. A transverse end cut 24 is made between the two welds 20 and 22 to form the two bags. It will be seen that in the flat condition the bags comprise two rectangular panels joined at their edges 12 and at the end welds. 14.

The apparatus also makes a separating cut 26 which will form the open ends 28 for each of the two bags that are formed between a pair of end cuts 24. The separating cut 26 is located midway between the end cuts 24 and is generally sinusoidal having a central crest 26.1, two valleys 26.2 on either side of the crest 26.1 and two half crests 26.3 outside the valleys 26.2. Therefore in each of the bags 30 and 32 that are thus formed cut-outs 34 to leave projecting tie parts 36 in the other bag which tie parts 36 are capable of being tied together to close the opening as will be described.

It will be seen that the two bags 30 and 32 have open ends which when the bags are in the lay-flat condition appear to be of different appearance. However once these ends are open, they will be of the same shape each with two cut-outs 34 and two projecting tie parts 36. The cut-outs 34 and tie parts 36 are all identical.

When the bag 10 is filled with refuse (as shown in FIG. 3), the diametrically opposite projecting tie parts 36 can be tied together to provide a substantially complete closure for the opening to the bag 10. (In the FIG. 3, there are shown openings 34 between the tie parts 36. This is for the purpose of clarity only and in fact these openings will be very small indeed.)

I have found that this closure is more than adequate for the normal purposes to which the bag 10 is put in domestic circumstances.

In this specification I have used the term "cut" in a broad sense with the intention that it covers both a parting cut which parts one item from another and a perforation cut which provides a line of weakness that permits the items to be parted from one another conveniently by tearing or pulling. Thus the bags will either be provided as separate items or as separable parts of an elongated roll of material which can be parted therefrom either in a commercial outlet or in the home when required.

It will be seen that by making the bags as described above a considerable amount of material is saved in addition to providing bags which are convenient to use for tieing corners to close the open ends. This is because with conventional bags only a portion can be filled if material is to be left to form ties. The upper limit of such filling is normally no more than a position slightly lower than the valleys of the cut-outs 34. Furthermore by having a straight end weld, the bag is capable of being filled to the maximum amount. Thus for forming bags 10 of the invention of the same practical capacity as conventional bags, up to 10% (ten percent) of the bag-forming material may be saved.

The invention is not limited to the precise constructional details hereinbefore described and illustrated. For example the bags may have more projections and cut-outs. The shape of the projections and cut-outs may vary as desired. These are preferably shapes with rounded corners but they may be zig-zag or rectangular in shape preferably with suitable means being provided to prevent tearing at the corners. The bags may be formed in pairs joined at perforation cuts at either the open or the closed end.

The bags may also be used for other storage or transport purposes such as carrier bags as used in shops and supermarkets. The sizes of the bags may vary in dependance upon the task to which the bags are to be put.

The bags may be gussetted if desired even though this will reduce the capacity of the bag as compared to that described above. However the provision of the straight closed end and the interleaved cut-outs and tie parts results in the bag having a larger capacity than the known bags mentioned above.

The currently preferred plastics materials are high density or low density polyethylene or polypropylene. Other plastics materials are appreciated by those skilled in the art.

I claim:

1. A roll of tubular plastics material from which is formed a plurality of refuse bags used for storing and/or transporting material such as garbage or refuse prior to collection or transport to disposal comprising:

(a) front and rear panels of material;

(b) straight end welds that weld the panels together at suitably spaced locations, transversely to the direction of the bag;

(c) an end cut adjacent to each end weld, and (d) a transverse separating cut forming an open end for two refuse bags between two pairs of end welds, the said separating cut being so shaped that four cut-outs are formed in the said open ends to leave four projecting tie parts which in each bag are capable of being tied together to close the opening whereby each bag has a capacity substantially equal to a rectangular refuse bag having no tie parts and is formed by substantially less bag forming material than such a rectangular refuse bag.

2. A roll of tubular plastics material from which is formed a plurality of refuse bags used for storing and/or transporting material such as garbage or refuse prior to collection for or transport to disposal comprising:

(a) front and rear panels of material lying flat one on the other and having side edges at which they are joined;

(b) pairs of closely spaced straight end welds the panels together at suitably spaced locations, transversely to the said edges;

(c) a set of perforations extending across the roll between each set of end welds; and (d) a line of perforations extending transversely across the roll midway between two adjacent pairs of end welds to form an open end for two contiguous refuse bags between a pair of end welds, the said set of perforations being so shaped that when the material of the roll is torn along the said line of perforations, four cut-outs are formed in the said open ends to leave four projecting tie parts which in each bag are capable of being tied together to close the opening whereby each bag has a capacity substantially equal to a rectangular refuse bag having no tie parts and is formed by substantially less bag forming material than a rectangular refuse bag.

3. A roll of tubular plastics material as claimed in claim 2 in which the said line of perforations is generally sinusoidal and comprises a complete crest, two valleys one on either side of the crest and two half crests respectively outside the valleys so that both bags formed by tearing along the said sinusoidal line of perforations will have four tie parts.

4. A roll of tubular plastics material as claimed in claim 1 in which the said transverse separating cut is generally sinusoidal and comprises a complete crest, two valleys one on either side of the crest and two half crests respectively outside the valleys so that both bags formed by tearing along the said sinusoidal cut will have four tie parts.

* * * * *